United States Patent [19]

Leichtfried, Friedrich

[11] Patent Number: 4,625,991

[45] Date of Patent: Dec. 2, 1986

[54] HEEL HOLDER

[75] Inventor: Leichtfried, Friedrich, Traiskirchen, Austria

[73] Assignee: TMC Corporation, Baar/Zug, Switzerland

[21] Appl. No.: 727,703

[22] Filed: Apr. 26, 1985

[30] Foreign Application Priority Data

May 4, 1984 [AT] Austria ..... 1480/84

[51] Int. Cl.[4] ..... A63C 9/08

[52] U.S. Cl. ..... 280/632

[58] Field of Search ..... 280/626, 631, 632, 628

[56] References Cited

U.S. PATENT DOCUMENTS

| | | | |
|---|---|---|---|
| 3,778,073 | 12/1973 | Salomon | 280/632 |
| 3,876,219 | 4/1975 | Smolka et al. | 280/628 |
| 3,933,363 | 1/1976 | Schweizer et al. | 280/632 |
| 4,183,549 | 1/1980 | Salomon | 280/632 |

FOREIGN PATENT DOCUMENTS

| | | | |
|---|---|---|---|
| 2628748 | 12/1977 | Fed. Rep. of Germany . | |
| 2900239 | 7/1979 | Fed. Rep. of Germany | 280/632 |
| 1485708 | 5/1967 | France . | |
| 2116767 | 7/1972 | France . | |

*Primary Examiner*—John J. Love
*Assistant Examiner*—Michael Mar
*Attorney, Agent, or Firm*—Flynn, Thiel, Boutell & Tanis

[57] ABSTRACT

The invention relates to a heel holder, the bearing block of which carries in the upper region thereof a pivot axle for a binding housing having a down-holding means and a stepping mandrel. In the lower region of the bearing block there is arranged a pivot axle for a control lever. A two-arm release lever is hingedly secured to the control lever, an arm of which release lever engages a projection on the binding housing. In order to avoid damage to the control lever during an opening of the heel holder by stepping down on the release lever with the other ski, the invention provides that the pivot axle for the release lever be guided in a slotted hole in the control lever and in two arc-shaped slotted holes in the sidewalls of the bearing block.

6 Claims, 5 Drawing Figures

HEEL HOLDER

FIELD OF THE INVENTION

The invention relates to a heel holder for a ski binding.

BACKGROUND OF THE INVENTION

Such a heel holder is described in French Patent No. 1 485 708. The axle for the release lever is arranged nonshiftably in the control lever. If the heel holder is opened voluntarily, which happens very often in practice and at times is also carried out by stepping down on the release lever with the other ski, damage to the control lever can occur due to the components of the release force acting in direction of the longitudinal axis of the release lever.

The goal of the invention is to overcome this disadvantage and to provide a heel holder wherein damage to the control lever does not occur, not even when the user handles the heel holder in a very rough manner.

The idea to guide pivot axles of levers in slotted holes is actually already known in heel holders, as is shown in German OS No. 26 28 748 (see FIG. 2). However, here the pivot axle for the control lever itself is guided in slotted holes in the bearing block.

BRIEF DESCRIPTION OF THE DRAWINGS

Two exemplary embodiments of the inventive heel holders are purely schematically illustrated in the drawings, in which.

DETAILED DESCRIPTION

Figure 1:
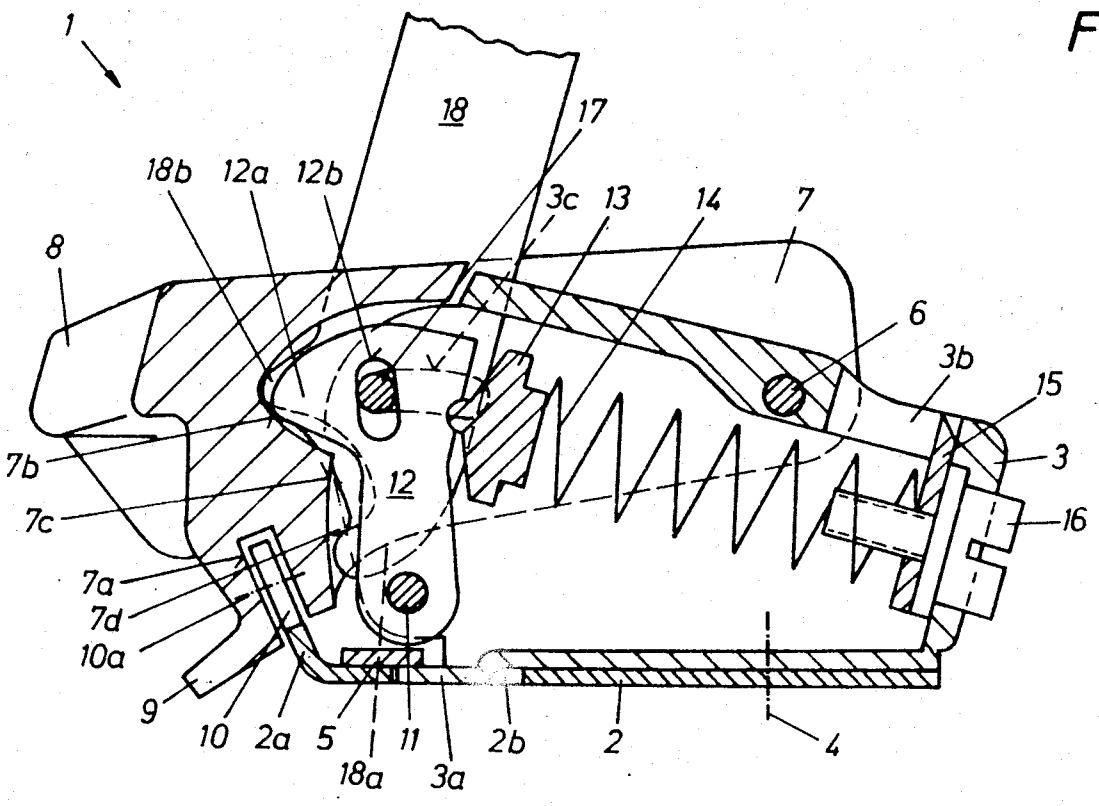
FIGS. 1 and 2 illustrate central vertical longitudinal cross sections of a first embodiment in the skiing position and in the open position.
Figure 2:
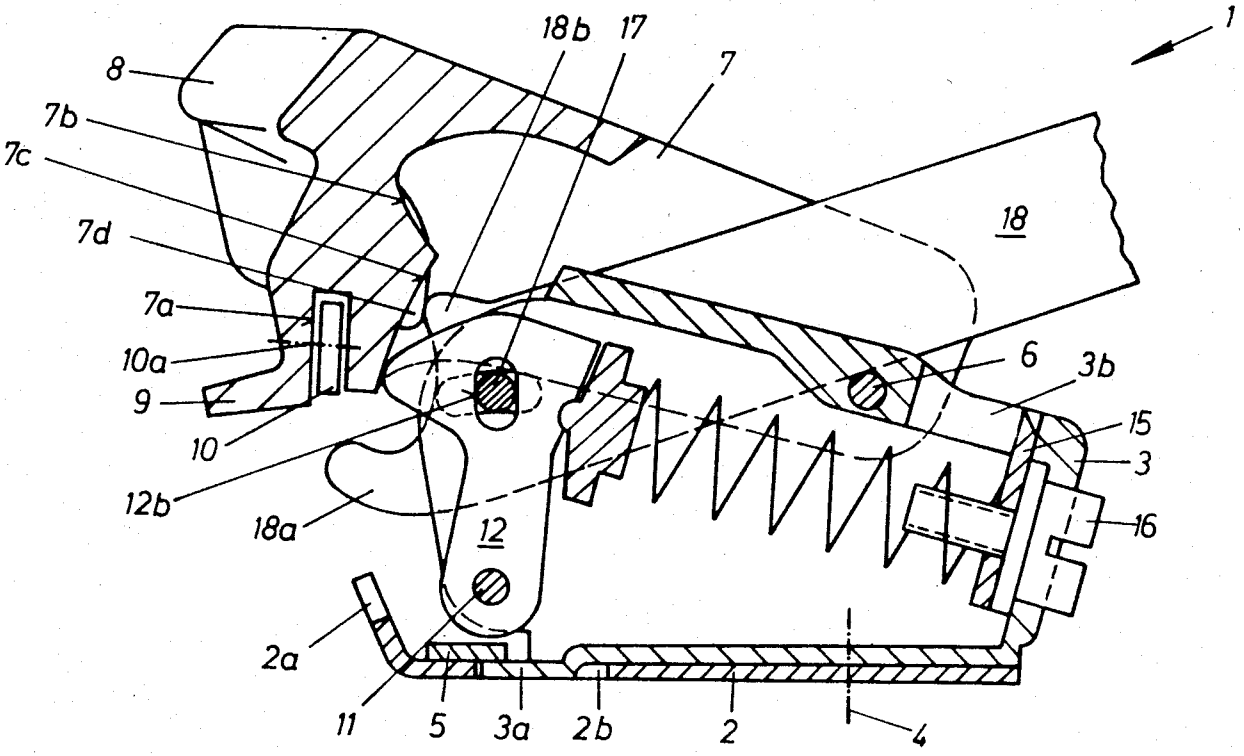

The heel holder which is illustrated in FIGS. 1 and 2 is identified in its entirety by the reference numeral 1. It has a base plate 2 having at its forward end adjacent the ski shoe a bent section 2*a*. The bent section 2*a* has a controlling cam path thereon for facilitating a lateral release. A bearing block 3 is pivotally supported for movement about a vertically upright axle 4 on the base plate 2. The bearing block 3 has an offset portion 3*a* which is received in a slot 2*b* of the base plate 2. A cover plate 5 is fastened to the base plate and overlaps the offset portion to prevent the offset portion 3*a* from moving perpendicularly with respect to the base plate. The bearing block 3 in this manner cannot be lifted up from the base plate 2 at its end adjacent the ski shoe.

A transversely extending pivot axle 6 is arranged in the upper boundary wall of the bearing block 3. A binding housing 7 is pivotally supported on the axle 6 and supports at its front end a down-holding means 8 and a stepping spur 9. A downwardly open groove 7*a* having a rectangular cross section, is arranged in the front boundary wall of the binding housing 7. A roller 10 is rotatably supported in the groove 7*a* on an axle 10*a*, which roller is operatively associated with the controlling cam path on the bent section 2*a* of the base plate 2. Furthermore, a rearwardly facing surface is provided on a boundary wall of the down-holding means 8 adjacent the ski shoe, which surface defines a controlling cam path consisting of an upper segment 7*b* and a lower segment 7*c* which segments meet at a release point for the heel holder 1.

A second axle 11 is provided in the lower region of the sidewalls of the bearing block 3 adjacent the ski shoe. A control lever 12 is pivotally supported on the second axle. The control lever 12 has on the side thereof facing the ski shoe a nose 12*a* designed to engage the controlling cam path 7*b*, 7*c*. A groove which extends in the transverse direction and which is shaped in the form of a circular-segment or is semicircularly shaped is recessed in the side of the control lever 12 remote from the nose 12*a*. A pressure piece 13 is swingably supported in the groove. The pressure piece 13 is engaged by one end of a release spring 14, the other end of which is supported on a spring washer 15 which simultaneously forms an indicator for indicating the magnitude of the initial tension of the release spring. The initial tension of the release spring can be adjusted by means of an adjusting screw 16 movable in the direction of the axis of the release spring 14. The adjusting screw 16 is rotatably supported, however, secured against an axial shifting in the bearing block 3. The indicator of the spring washer 15 is guided in a slot 3*b* in the bearing block 3 and in this manner secures the spring washer 15 against rotation.

The control lever 12 has between the nose 12*a* and the circular-segment-shaped groove a slotted hole 12*b* which extends approximately radially with respect to its pivot axle 11. An axle 17 extends through the hole 12*b* and, furthermore, extends through slotted holes 3*c* in the sidewalls of the bearing block 3 and on which is secured a release lever 18. Impacts, which are applied onto the release lever 18 in direction of its supporting axle 17 can through this measure be isolated from the control lever 12. The release lever 18 is—viewed in the longitudinal direction of the ski—substantially U-shaped with the two legs thereof being supported on the axle 17 guided in the slots of the binding housing 7, which slots extend in the longitudinal direction of the ski. The end 18*a* of an arm on each leg of the release lever 18 is constructed approximately hook-shaped and grips under a projection 7*d* on the binding housing 7. The release lever 18 in addition has another projection 18*b* thereon, which in the skiing position rests on the extension of the projection 7*d* or cam surface segments 7*b*, 7*c* on the binding housing 7. The position of the release lever 18 in the closed position of the binding housing 7 is determined through this. Whereas in the open position of the binding housing 7, the projection 7*d* of the binding housing engages the projection 18*b* of the release lever 18. Since the release lever 18, on the one hand, is supported on the pivot axle 6 and, on the other hand, on the control lever 12 engaged by the release spring 14, the binding housing 7 is secured against a further opening, since, in order to bring about a further pivoting, the force of the release spring 14 would have to be overcome. Of course the resistance against a further opening in the binding housing 7 increases with an increase in the adjusted release force.

During an automatic release of the heel holder 1, the nose 12*a* of the control lever 12 slides first over the upper surface segment 7*b* to the point of intersection of the two surface segments 7*b*, 7*c*, which define the release point. The nose 12*a* moves subsequently along the lower surface segment 7c, which movement is resisted by the release spring 14.

If, however, a voluntary release is to be started, then the release lever 18 is pivoted clockwise. The binding housing 7 is thereby lifted by means of the end 18*a* of the arm on the release lever 18, which end grips under the binding housing 7 up to and until the nose 12*a* of the control lever 12 has passed the release point of the controlling cam path formed by the two surface segments 7*b* and 7*c*. The heel holder 1 subsequently opens by itself under the influence of the release spring 14.

Figure 3:
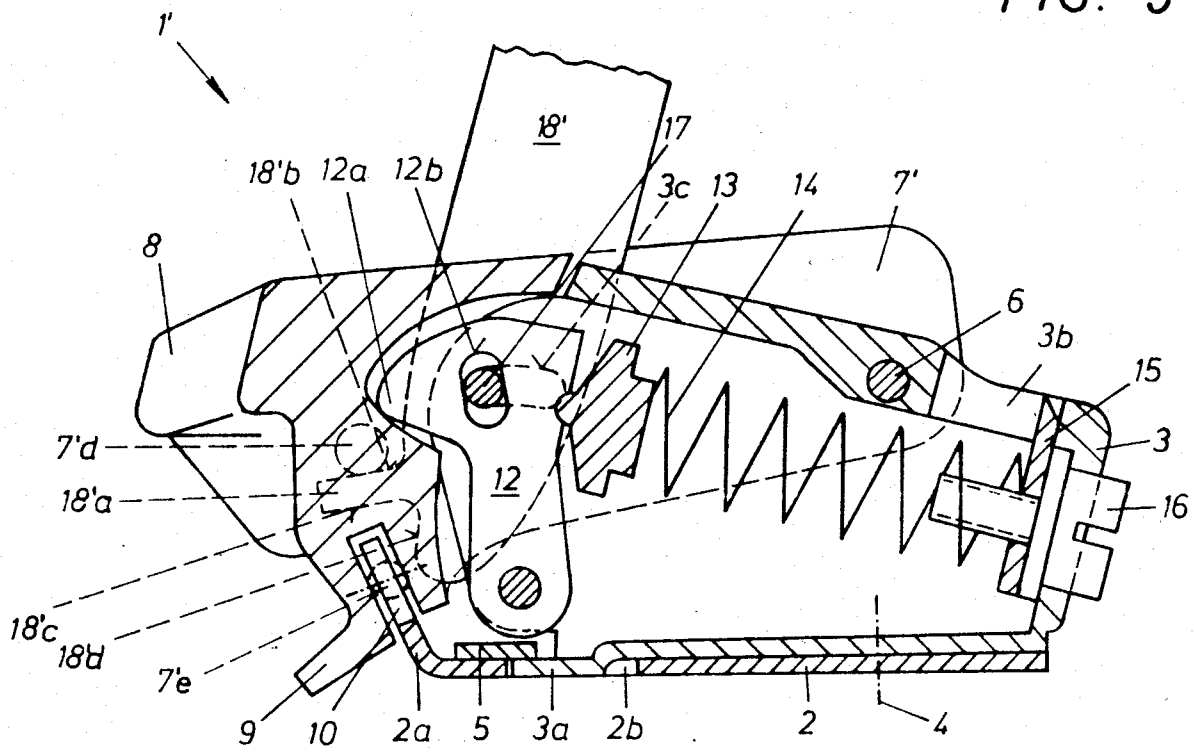
FIGS. 3–5 illustrate a central vertical longitudinal center cross section of a second embodiment in the skiing position (FIG. 3), in the center position of the release lever in which the control lever contacts the release point (FIG. 4), and in the end position of the release lever (FIG. 5).
Figure 4:
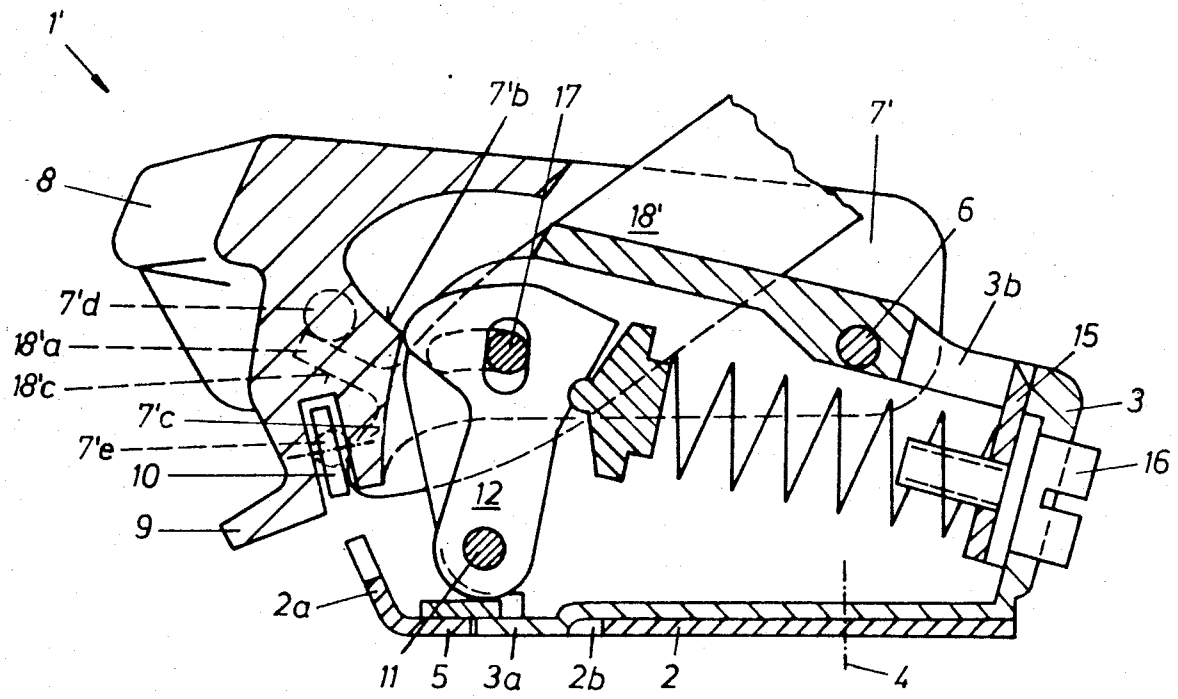
Figure 5:
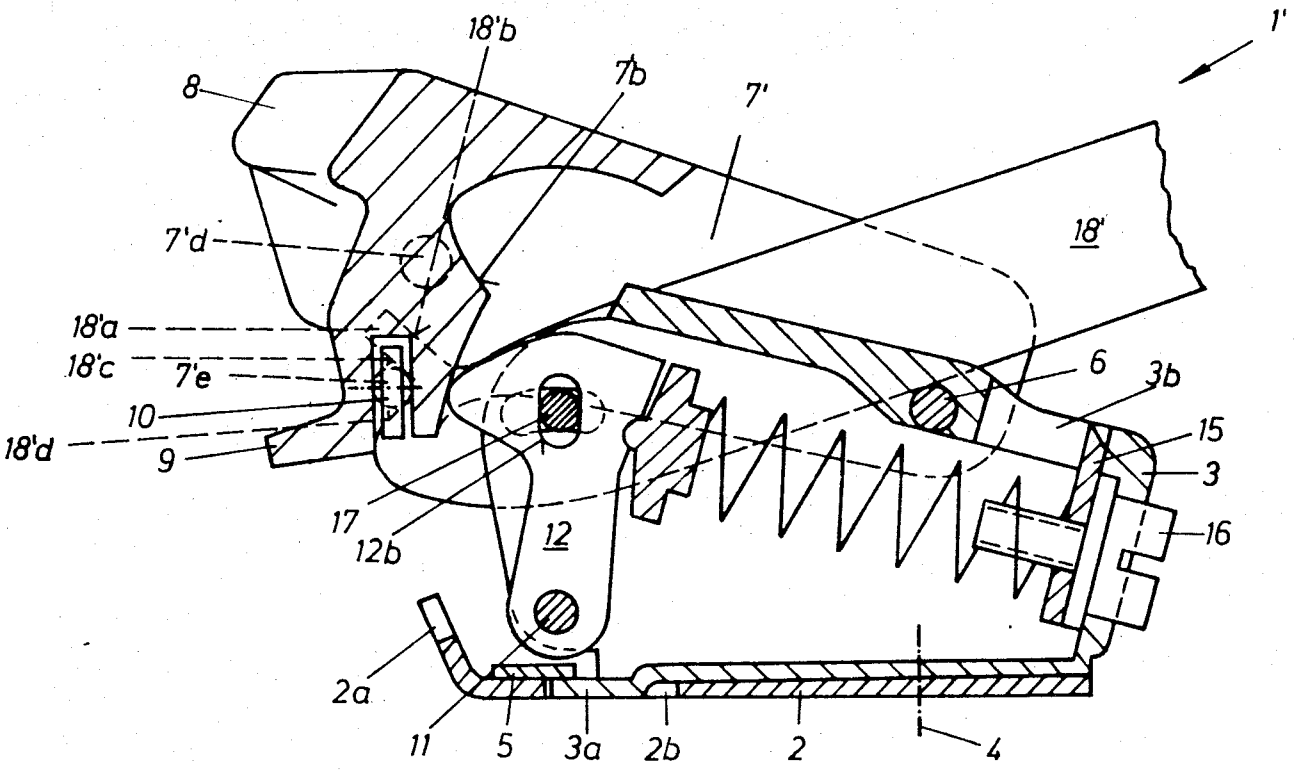

The exemplary embodiment 1' of a heel holder illustrated in FIGS. 3–5, is very similar to the first embodiment. It differs from the first embodiment only in that the binding housing 7' carries not one, but two projections 7'*d* and 7'*e* on each side, each of which project into slots in which the legs of the release lever 18' are guided during a pivoting movement. The release lever 18' carries on each leg a projection 18'*a*, which extends approximately perpendicularly with respect to its longitudinal axis and which will extend between the projections 7'*d* and 7'*e* of the binding housing 7'.

The operation during the automatic release corresponds to the operation of the first exemplary embodiment.

The voluntary release of the heel holder 1', however, is slightly different. First, the upper projection 7'*d* engages the upper side 18'*b* of the projection 18'*a* (see FIG. 3). If the release lever 18' is now swung in clockwise direction (see FIG. 4), then the binding housing 7' is lifted by the projection 18'*a* up to and until the release point, that is, the point of intersection of the surface segments 7'*b* and 7'*c* of the controlling cam path, has been exceeded. Starting with this point in time, the upper projection 7'*d* of the binding housing 7' moves away from the upper side 18'*b* of the projection 18'*a* of the release lever 18', and the lower projection 7'*e* of the binding housing 7' comes into contact with a controlling cam path 18'*d* formed on the arm on the release lever 18'. This opening movement of the heel holder 1' is simultaneously resisted by the release spring 14. This movement ends when the release lever 18' rests on the pivot axle 6 of the binding housing 7'. Since, however, the pivoting movement of the binding housing 7' continues under the influence of the release spring 14, the lower projection 7'*e* of the binding housing will engage the underside 18'*c* of the projection 18'*a* of the release lever 18'. The open position of the heel holder 1' is achieved by this (see FIG. 5).

Of course it is possible to step into the heel holder 1' with a ski shoe without pivoting the release lever 18'. If, however, during the stepping-in operation simultaneously with a stepping down onto the stepping mandrel 9, the release lever 18' is pivoted counterclockwise, then the work which is to be done by the foot of the user is substantially reduced, especially since the lower projections 7'*e* of the binding housing 7' are moved downwardly by the release lever 18' with a very large translation ratio by the projection 18'*a* of the release lever 18'.

A similar operation is also possible in the first exemplary embodiment.

The embodiments of the invention in which an exclusive property or privilege is claimed are defined as follows:

1. In a heel holder having a base plate adapted to be secured to a ski, a bearing block and means for pivotally supporting said bearing block on said base plate, in an upper region of said bearing block there is arranged a first pivot axle for a binding housing having down-holding means thereon and a stepping spur and in the lower region of said bearing block there is arranged a second pivot axle for a control lever, said control level engaging a control element movably supported on said binding housing, a resilient means for urging said control element into engagement with said control lever, adjusting means for adjusting an initial force at which said resilient means urges said control element into engagement with said control lever, a two-arm release lever hingedly secured to said control lever, an arm on said release lever engaging a projection on said binding housing, the improvement comprising wherein a third pivot axle for said release lever is guided in a slotted hole in said control lever, said slotted hole extending approximately radially with respect to said second pivot axle of said control lever, said third pivot axle also being guided in two arc-shaped slotted holes provided in sidewalls on said bearing block, said arc-shaped slotted holes having as their centerpoint the centerpoint of said third pivot axle for said control lever.

2. The heel holder according to claim 1, wherein said release lever is hook-shaped in its end region facing said projection on said binding housing, wherein in an open condition of said binding housing, said projection is supported on a shoulder on said release lever, and wherein said release lever rests on said first pivot axle of said binding housing and on said control lever against said force of said resilient means.

3. The heel holder according to claim 1, wherein lateral sides of said release lever each have a first projection thereon extending approximately transversely with respect to a longitudinal axis of said release lever, wherein on said binding housing on each lateral side at a distance from said first projection there is provided a further projection, and wherein said first projection on each side of said release lever extends between said projection and said further projection on said binding housing.

4. The heel holder according to claim 3, wherein each said first projection on said release lever—viewed in transverse direction of said ski—has approximately the shape of a rectangle, the upper surface and lower surface of which engages said projection and said further projection for effecting movement of said binding housing.

5. The heel holder according to claim 3, wherein below each said first projection on said release lever there is provided a controlling cam path for said control lever associated with the lower one of said projection and said further projection on said binding housing.

6. The heel holder according to claim 3, wherein the angle of traverse of said release lever is limited by said release lever engaging said first pivot axle for said binding housing.

* * * * *